US007015812B1

(12) United States Patent
Lemchen

(10) Patent No.: US 7,015,812 B1
(45) Date of Patent: Mar. 21, 2006

(54) SOUND PROTECTING HEADSET WITH PROXIMITY COLLISION AVOIDANCE PROTECTION

(76) Inventor: Marc S. Lemchen, 165 E. 74th St., New York, NY (US) 10021

( * ) Notice: Subject to any disclaimer, the term of this patent is extended or adjusted under 35 U.S.C. 154(b) by 0 days.

(21) Appl. No.: 08/539,320

(22) Filed: Oct. 4, 1995

(51) Int. Cl.
*G08B 13/00* (2006.01)

(52) U.S. Cl. ..... 340/541; 128/864; 340/552; 342/27; 367/93; 367/116; 367/909

(58) Field of Classification Search ..... 340/541, 340/436, 903, 552, 555, 567, 568.1, 328, 340/435; 367/93–94, 909, 116; 342/27–28; 128/864, 867, 868; 381/23.1, 68.1, 69; 181/129, 181/135; 455/351, 89
See application file for complete search history.

(56) References Cited

U.S. PATENT DOCUMENTS

| | | | | | |
|---|---|---|---|---|---|
| 3,321,737 | A | | 5/1967 | Russell | 367/116 |
| 3,546,467 | A | | 12/1970 | Benjamin, Jr. et al. | 250/215 |
| 3,654,477 | A | | 4/1972 | Benjamin, Jr. | 250/552 |
| 3,993,407 | A | | 11/1976 | Moricca et al. | 356/3.14 |
| 4,223,189 | A | * | 9/1980 | Warren | 181/135 |
| 4,280,204 | A | | 7/1981 | Elchinger | 367/116 |
| 4,299,303 | A | * | 11/1981 | Clark | 181/135 X |
| 4,516,125 | A | * | 5/1985 | Schwab et al. | 342/36 |
| 4,528,563 | A | | 7/1985 | Takeuchi | 340/903 |
| 4,658,931 | A | * | 4/1987 | Curry | 181/129 |
| 4,694,296 | A | | 9/1987 | Sasaki et al. | 340/904 |
| 4,761,770 | A | | 8/1988 | Kim et al. | 367/116 |
| 4,777,474 | A | * | 10/1988 | Clayton | 381/23.1 X |
| 4,788,724 | A | * | 12/1988 | Lazzeroni et al. | 455/351 X |
| 4,928,101 | A | | 5/1990 | Favors | 340/943 |
| 4,937,795 | A | | 6/1990 | Motegi et al. | 367/93 |
| 4,967,641 | A | | 11/1990 | Chambre | 367/116 X |
| 4,979,586 | A | * | 12/1990 | Lazzeroni et al. | 181/129 |
| 5,059,946 | A | | 10/1991 | Hollowbush | 340/903 X |
| 5,073,947 | A | * | 12/1991 | Reddemann et al. | 181/135 X |
| 5,339,075 | A | | 8/1994 | Abst et al. | 340/903 |
| 5,341,346 | A | | 8/1994 | Youlton | 367/116 X |
| 5,515,026 | A | * | 5/1996 | Ewert | 340/436 |

FOREIGN PATENT DOCUMENTS

| | | | | |
|---|---|---|---|---|
| JP | 7396 | * | 1/1994 | 128/867 |

* cited by examiner

*Primary Examiner*—Thomas Mullen
(74) *Attorney, Agent, or Firm*—Daniel L. Dawes; Myers Dawes Andras & Sherman LLP

(57) ABSTRACT

A proximity warning system is disposed in a sound protecting earmuff-type headset or other means of providing acoustic ear protection. The ear protector prevents the user from hearing damage from high levels of ambient sound and would otherwise generally make the user unable to hear the sounds of approaching objects like vehicles and machinery. However, an audio transducer is provided in each ear shell of the headset and is connected to a ranging device, which in the illustrated embodiment is an infrared ranging device which generates an alarm signal upon the approach of an object within a predetermined critical alarm limit. A plurality of variable alarm signals can be provided to distinguish the direction, size and speed of the approaching object. In general, the ranging device may be optical, acoustic, thermal or electromagnetic.

20 Claims, 3 Drawing Sheets

SOUND PROTECTING HEADSET WITH PROXIMITY COLLISION AVOIDANCE PROTECTION

BACKGROUND OF THE INVENTION

1. Field of the Invention

The invention relates to the field of sound protection devices, whereby a worker is protected from auditory damage by protecting headset, but is also provided with an auditory warning concerning possible collision with approaching vehicles, machinery or people.

2. Description of the Prior Art

Motegi et al., "Access Alarming Method and Apparatus for Working Vehicle," U.S. Pat. No. 4,937,795 (1990), describes an access alarm method which is used to detect the distance between a vehicle, such as a road roller, to an object, such as a worker in the proximity of the vehicle. An ultrasonic wave is transmitted by a transmitter worn by the worker and is received by a receiver in the road roller. The received signal is processed to determine the relative position of the vehicle relative to the worker. An alarm is activated and/or the vehicle is braked when the worker comes within the hazard area of the vehicle based on the position and direction of the vehicle's movement.

In a second embodiment of the system, the worker's ultrasonic system provides an output on a continuous basis in order to increase the reaction time of the system. In the embodiment of FIG. 24, the workers helmet 3 is fitted with ultrasonic transmitting and receiving units 5 disposed in a radially spaced configuration for omnidirectional use.

In Motegi the individual is wearing the transponder which the working vehicle detects and ranges. Presumably, the worker remains uninformed and oblivious to the approaching hazard or the near collision event. Motegi thus is subject to the disadvantage that it provides no protection against vehicles or objects not similarly fitted with a transponder and control device. It also fails to warn the worker that he may be in an area of repeated collision hazard.

Russell, "Sonar-Type Sensory Aids," U.S. Pat. No. 3,321,737 (1967), describes a device to be worn on the body using ultrasonics to detect obstacles. As shown in FIG. 4, the audio output provided to a speaker 24 generates an audio frequency, which varies as a function of the distance of the user and the object with the variation in frequency being in discrete steps. Further, the amplitude of the signal may be very responsive to the rate at which the distance between the user and object closes similar to your own disclosure.

The Russell device is an aid to the blind, provides a personal audio alarm and responds to sonic ranging of general surrounding objects, ostensibly for the purpose of collision avoidance. The audio feedback is varied to determine the distance to the object. The device is directional and therefore provides directionality according to how the user turns or sights the device. The detection and ranging elements are thus focussed, are not omnidirectional, do not provide stereo generation of audio signals indicative of the direction of approach, and thus are not suitable for collision avoidance.

Benjamin, Jr., "Obstacle Detection System for use by Blind Comprising Plural Ranging Channels Mounted on Spectacle Frames," U.S. Pat. No. 3,654,477 (1972), and Moricca et al., "Polysensory Mobility Aid," U.S. Pat. No. 3,993,407 (1976), teach devices directed to obstacle detection incorporated in a eyeglass-type structure. This system is incorporated into eyeglass frames as opposed to ear coverings, and thus does not provide any sound protection.

Chambre, "Device to Assist an Operator with Target Acquisition in a Weapons System," U.S. Pat. No. 4,967,641 (1990), shows a means by which the operator received target information that is being supplied stereophonically to the operator's helmet. Data representing the approach of the object is identified to the helmet wearer whereas an alarm transmitted in stereo gives a subjective sense of direction of the approaching target.

Takeuchi, "Rearward Obstruction Sensing System for Automotive Vehicle," U.S. Pat. No. 4,528,563, which describes a detection system, although not a personal warning device, shows the use of four speakers through which an alarm signal is provided to the vehicle operator. The warning signal is directed to a particular speaker so that the driver subjectively recognizes the direction of the obstruction in the manner in which we have suggested. Further, the driver can determine the obstruction distance by distinguishing the period of the intermittent alarm signals.

Abst et al., "Vehicular Collision Avoidance Apparatus," U.S. Pat. No. 5,339,075 (1994), describes a system in which audio signals are provided to a user as a warning in a manner which is indicative of the relative speed and position of the approaching object. Three distinct audible warning tones are provided to indicate a vehicle approaching with greater speed, a vehicle within a predetermined distance but which is receding, and vehicle within a predetermined distance whose relative speed is the same as the driver.

Sasaki et al., "Vehicle Approach Sensing Apparatus," U.S. Pat. No. 4,694,296 (1987), shows a system in which a warning signal is provided to the user whenever a closing speed of a vehicle exceeds a predetermined value.

What is needed is some type of sound protection system which still allows for omnidirectional and meaningful audio warning of approaching objects.

BRIEF SUMMARY OF THE INVENTION

The invention is an apparatus comprising an ear protector for providing acoustic isolation for an user. A ranging circuit is disposed at least in part within the ear protector for detecting the proximity of an object and for generating an audible alarm signal. The audible alarm signal is communicated within the ear protector to allow the user to respond to the audible alarm signal without compromise of sound protection by the ear protector. As a result, safe use of the ear protector in a hazardous environment where collision potential exists is achieved.

The ear protector substantially attenuates substantially all audible frequencies including audio frequencies associated with the hazardous environment including in general the very frequency of the audible alarm itself.

The ranging circuit may comprise an infrared ranging circuit, an optical ranging circuit, a radio frequency ranging circuit, a radar, electromagnetic or capacitive ranging circuit, a thermal ranging circuit, an acoustic ranging circuit or even combinations of the same.

The ranging circuit generates a variable audio alarm indicative of a relationship of an object in the hazardous environment to the user, such as providing an indication of the direction of approach of the object to the user, an indication of the speed of approach of the object toward the user, an indication of the size of the object approaching the user, or any combination of the same.

The invention is also defined as a method for providing protection against acoustic injury in a noisy environment while still providing an audio proximity alarm to warn against collision hazard. The invention comprises the steps of providing a user with acoustic ear protection and disposing within the acoustic ear protector an audio transducer for producing an audible alarm without compromising the acoustic attenuation by the ear protector. A ranging circuit is coupled to the alarm, determines the proximity of an object, and is mounted on or in the acoustic protector such that it is portable and entirely self-contained with the user.

The invention and its various embodiments may be better visualized by now turning to the following drawings wherein like elements are referenced by like numerals.

The invention and its various embodiments may now be understood by turning to the following detailed description.

DETAILED DESCRIPTION OF THE PREFERRED EMBODIMENTS

A proximity warning system is disposed in a sound protecting earmuff-type headset or other means of providing acoustic ear protection. The ear protector prevents the user from hearing damage from high levels of ambient sound and would otherwise generally make the user unable to hear the sounds of approaching objects like vehicles and machinery. However, an audio transducer is provided in each ear shell of the headset and is connected to a ranging device, which in the illustrated embodiment is an infrared ranging device which generates an alarm signal upon the approach of an object within a predetermined critical alarm limit. A plurality of variable alarm signals can be provided to distinguish the direction, size and speed of the approaching object. In general, the ranging device may be optical, acoustic, thermal or electromagnetic.

Figure 1:
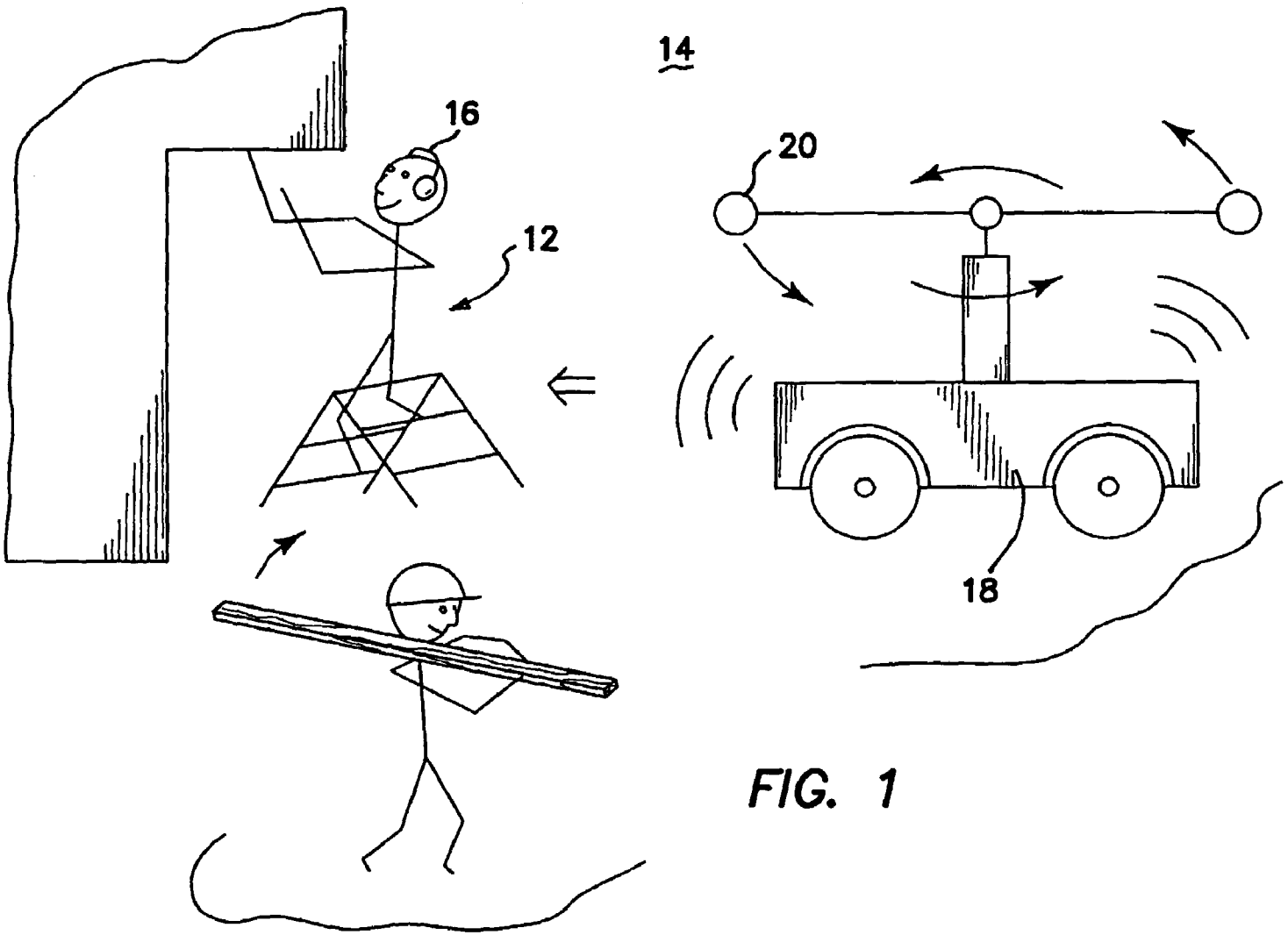
FIG. 1 is a symbolic diagram illustrating a situation in which the ear protection alarm system of the invention is utilized.

FIG. 1 is a diagram which symbolically indicates the situation in which the system of the invention, generally denoted by reference numeral 10, is utilized. A worker 12 is positioned within a high-noise environment 14. Because of the constant audio assault of noisy environment 14 on the worker's auditory nerves and chronic hearing loss that might otherwise occur as a result, the worker is fitted with sound protection headset 16. The sound protection aspects of the design of headset 16 are conventional and are of a type which prevents auditory damage to worker 12 by virtue of noisy environment 14. One of the disadvantages of sound protectors, such as sound protecting headset 16, is that while they muffle or screen out a broad spectrum of harmful sound, they also prevent the user from using normal auditory cues, which might otherwise be discernible in noisy environment 14, to prevent collision with vehicles or machinery.

For example, as shown in FIG. 1, worker 12 is engaged in a task in work environment 14, which draws all of his attention and his totally occupies his visual senses. However, because the worker must wear headset 16 in environment 14, he is unable to hear the approach of a vehicle 18, or nearby movement of machinery 20. These normal work hazards thus remain undetected and may, during normal working situations, be brought into the proximity of worker 12 such that collision or injury occurs.

Figure 2:
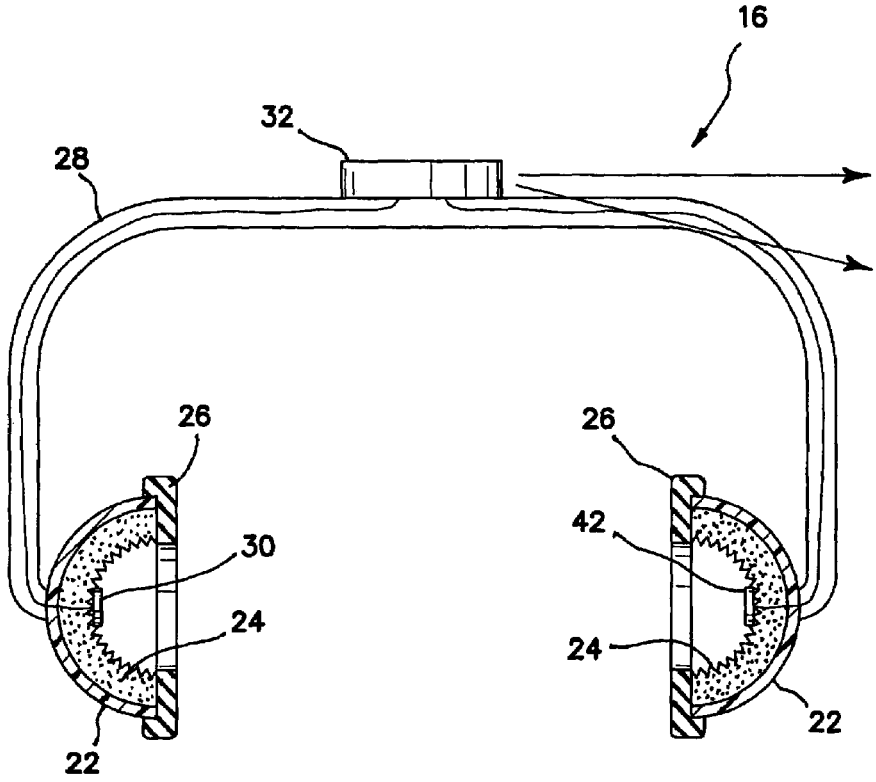
FIG. 2 is a simplified side view of the headset shown in FIG. 1.

The worker can be warned and this injury avoided without exposing the worker to chronic auditory damage through the use of an ear protection system 10 such as shown in FIG. 2. Earmuff-type headset 16, shown in cross sectional view, is comprised of a pair of hard outer shells 22 within which a conventional acoustical absorber 24 has been disposed. The means by which headset 16 provides sound protection is immaterial, and any means now known or later devised may be employed. The point is to be made, however, that the invention may be used with a broadband and very highly effective sound absorber 24, which would normally allow substantially no sound at any frequency to penetrate at a sensible level to the user's ears.

Sound protector headset 16 may further include any type of mechanism for fitting and providing comfort to the user's head and ears. For example, a cushioned sound-deadening rim 26 is illustrated and the two identical and symmetric ear protectors are joined together by means of an adjustable and resilient head-strap 28. Again, the details of the structure and the means used to fit or retain sound protector or headset 16 on user 12 is largely irrelevant to the invention as described in the specification.

For example, although a headband 28 has been described, it is possible that helmet-mounted systems, neck-mounted systems, or even in-ear sound protectors utilizing the invention could be substituted without departing from the scope of the invention. The principal requirement of the sound protection system or headset 16 is only that it substantially mutes or attenuates all or some of the frequencies which the user would normally hear and respond to as a work hazard.

Headset 16 differs from any previously devised ear protector by incorporation of a ranging or proximity alarm system. In the illustrated embodiment, system 10 includes an audio output transducer 30 fitted into one or both of the ear protectors shells 22 and a sensing device 32 operatively connected thereto. Sensing device 32 may be any type of proximity or ranging device now known or later devised. For example, it may be a high frequency or ultrasonic transmitter and receiver or ranging device, an infrared ranging device, a radar ranging device, a laser ranging device and capacitive or inductive or any other type of sensing system by which the proximity of an object can be determined. For example, in the illustrated embodiment, ranging device 32 is an infrared ranging device similar, in many respects, to an automatic camera ranging device used for automatic focusing.

Figure 3:
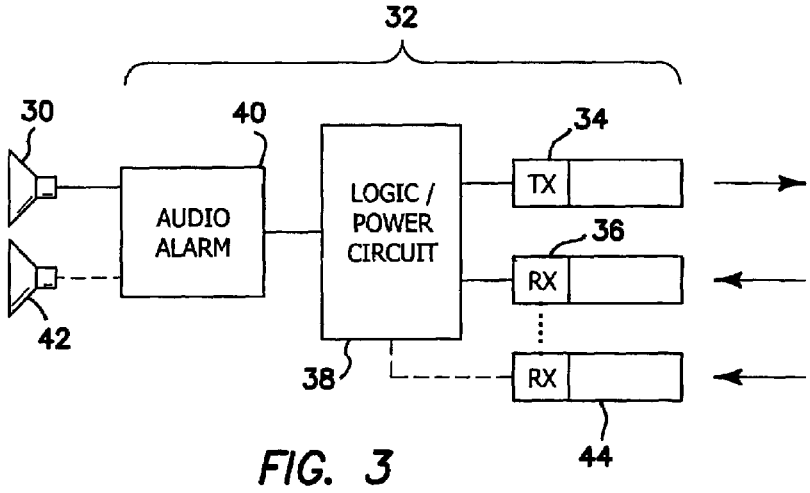
FIG. 3 is an idealized block diagram of one form of circuitry which may be used in the device of FIGS. 1 and 2.

As shown in FIG. 3, such a ranging device 32 is comprised of a transmitter element 34, here an infrared light source, and a receiving element 36, such as an infrared detector. In other situations, the same device may be used as a transmitter and receiver or multiplexed, such as is typical in radar systems.

In any case, a detection signal is generated by ranging device 32 and a response is obtained from the approaching or proximate object. In the illustrated device, infrared detector 36 and infrared source 34 are each coupled to a logic and power circuit 38 which provides the necessary biasing, conditioning and power signals to source 34 and detectors 36, 44 and provider a logic signal for discriminating or processing the response relative to the transmitted detection or ranging signal according to conventional design considerations.

The organization and design of circuit 38 may assume any configuration now known to the art or later devised as used in ranging and detection circuitry, and in a large part, be largely determined based upon the type of signal used for ranging and the transducers for both signal production and detection.

The discriminated or detected signal indicating the approach of an object or vehicle can then be used to produce one or more of a plurality of alarm signals which are coupled from circuit 38 to an audio alarm signal 40 and thence to a speaker audio transducer 30 in the proximity of the user's ear, but inside the sound protecting and muffling sound protecting headset 16. Therefore, user 12 will be able to hear the alarm signal from transducer 30 in an entirely unmuffled condition, while all or most exterior sound will be substantially attenuated.

The type of alarm signal now known or later devised may be given to user by logic circuit 38. For example, the pitch or repetition rate of the alarm can indicate the speed by which the object is approaching. The volume of the alarm may indicate the size of the object which is approaching. Alarms may be generated dependent on the achievement of critical thresholds such as minimum speeds, distances or combinations of both.

Receiving detector 36 may be directionally sensitive or plurality of such receivers may be used so that acoustic direction determination can be determined. Stereo signals may then be applied to two audio transducers 30 and 42, one in each of the ear protecting shells 22, to allow user 12 to have a sensual acoustic direction so that he may turn toward the direction of the approaching hazard.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. An apparatus comprising:

an ear protector for providing acoustic isolation for a user in a noisy environment;

a self-contained ranging means disposed entirely within said ear protector for detecting a moving object in the proximity, no part of said ranging means being disposed on or in said moving object, said moving object and user being present in said noisy environment, wherein said user is incapable of audibly detecting said object or its movement toward said user without using the ear a protector having an audio transducer; and means for generating an audible alarm signal when said moving object approaches said user, said audible alarm signal being communicated within said ear protector to allow said user to respond to said audible alarm signal without compromise of sound protection by said ear protector.

2. The apparatus of claim 1 wherein said ear protector substantially attenuates substantially all audible frequencies originating with an exterior source including audio frequencies associated with said noisy environment.

3. The apparatus of claim 2 wherein said audible alarm signal is characterized by at least one frequency, wherein said ear protector substantially attenuates said at least one frequency of said alarm signal, and wherein said at least one frequency is originated from said exterior source.

4. The apparatus of claim 1 wherein said ranging means comprises an infrared ranging means.

5. The apparatus of claim 1 wherein said ranging means comprises an optical ranging means.

6. The apparatus of claim 1 wherein said ranging means comprises a radio frequency ranging means.

7. The apparatus of claim 1 wherein said ranging means comprises a radar.

8. The apparatus of claim 1 wherein said ranging means comprises electromagnetic ranging means.

9. The apparatus of claim 1 wherein said ranging means comprises a thermal ranging means.

10. The apparatus of claim 1 wherein said ranging means comprises an acoustic ranging means.

11. The apparatus of claim 1 wherein said ranging means generates a variable of audio alarm indicative of a relationship of an object in said noisy environment to said user.

12. The apparatus of claim 11 where said variable audio alarm generated by said ranging means provides an indication of the direction of approach of said object to said user.

13. The apparatus of claim 12 wherein said variable audio alarm generated by said ranging means provides an indication of the speed of approach of said object toward said user.

14. The apparatus of claim 13 wherein said variable audio alarm generated by said ranging means provides an indication of the size of said object approaching said user.

15. The apparatus of claim 12 wherein said variable audio alarm generated by said ranging means provides an indication of the size of said object approaching said user.

16. The apparatus of claim 11 wherein said variable audio alarm generated by said ranging means provides an indication of the speed of approach of said object toward said user.

17. The apparatus of claim 16 wherein said variable audio alarm generated by said ranging means provides an indication of the size of said object approaching said user.

18. The apparatus of claim 11 wherein said variable audio alarm generated by said ranging means provides an indication of the size of said object approaching said user.

19. A method for providing protection against acoustic injury in a noisy environment while still providing an audio proximity alarm to warn against collision hazard comprising the steps of:

providing a user with a means for acoustic ear protection from said noisy environment;

disposing within said means for acoustic ear protection an audio transducer for producing an audio proximity alarm without compromise of acoustic attenuation by said means; and communicating a self-contained ranging means with said audio transducer, said ranging means for determining at least one parameter predicting collision with a moving object, said self-contained ranging means being coupled to said means for providing acoustic protection and entirely disposed in or on said means for providing acoustic protection so as to be portable with said user and entirely self-contained within said means for providing acoustic ear protection, said moving object and user being present in said noisy environment and said user incapable of audibly detecting said object or its movement toward said user without using a protector having an audio transducer;

whereby said audio proximity alarm is provided without compromise of acoustic ear protection.

20. The method of claim 19 wherein said step of disposing said audio transducer within said means for providing acoustic ear protection comprises the step of disposing an independently driven audio transducer in the proximity of each ear to provide stereo acoustic directional alarms.

* * * * *